US005141139A

United States Patent [19]

Kleeblatt

[11] Patent Number: 5,141,139

[45] Date of Patent: Aug. 25, 1992

[54] SLIDE GATE NOZZLE FOR METALLURGICAL VESSELS

[75] Inventor: Schmuel Kleeblatt, Mamer, Luxembourg

[73] Assignee: Cerafer S.A.R.L., Mamer, Luxembourg

[21] Appl. No.: 664,058

[22] Filed: Mar. 5, 1991

[30] Foreign Application Priority Data

Mar. 5, 1990 [DE] Fed. Rep. of Germany ..... 4006894

[51] Int. Cl.[5] ..... B22D 41/24

[52] U.S. Cl. ..... 222/600

[58] Field of Search ..... 266/236; 222/600, 591, 222/597; 164/337, 335

[56] References Cited

U.S. PATENT DOCUMENTS 3,765,579 10/1973 Cramer et al. ..... 222/600

FOREIGN PATENT DOCUMENTS 0679316 8/1979 U.S.S.R. ..... 222/600
1424966 9/1988 U.S.S.R. ..... 222/600
2169529 7/1986 United Kingdom ..... 222/600

*Primary Examiner*—Scott Kastler
*Attorney, Agent, or Firm*—Robert J. Koch

[57] ABSTRACT

A sliding gate valve for metallurgical vessels, such as pouring ladles, is disclosed. The sliding gate valve may include a slide gate housing fastenable to a melt-containing vessel. A heat-resistant closure plate may be held stationary by a movable slide plate pressing against the closure plate. The slide plate may be supported in a frame having two sets of rollers. The frame may be connected to a drive, for example a hydraulic or pneumatic drive. An aperture may be provided in the housing bottom for passage of the frame rollers therethrough. The distance corresponding to the axial spacing between the sets of rollers is equivalent to the distance corresponding to the axial spacing between side apertures of the bottom aperture. The axial spacing between the rollers corresponds to the axial spacing between the side apertures to allow for the simultaneous passage of both sets of rollers through the side apertures. The frame may be guided in the housing on a slide comprising side aperture closing portions which may be displaced to open and close the side apertures of the housing bottom. The frame and the slide may be provided with bores that may be temporarily and rigidly connected with each other by a connecting bolt. Each roller of one set of rollers may be equipped with a releasable connecting bolt cooperating with a housing receptacle.

20 Claims, 4 Drawing Sheets

SLIDE GATE NOZZLE FOR METALLURGICAL VESSELS

BACKGROUND OF THE INVENTION

1. Field of the Invention

The invention relates to a slide gate nozzle or valve for metallurgical vessels, in particular, a slide gate valve having a slide valve housing fastened to a melt-containing vessel, with a frame supported on two sets of rollers and having an opening provided in the housing bottom for passage of the rollers therethrough.

2. Description of the Related Technology

International Application WO88/01211 discloses a known slide gate valve in which the frame may be moved by a drive unit into a position outside the closed state, so the plate may be removed. According to the known slide gate valve, one of the two sets of rollers enters a depressed bearing trough, thus relieving the pressure applied to the slide in the operating position. The frame can then be released from the drive unit and after pivoting the frame, the used plate may be replaced.

SUMMARY OF THE INVENTION

It is an object of the present invention to provide a slide gate valve where it is possible to replace the plate or other mechanical parts of the slide gate valve in a simple manner.

According to the invention, this object may be attained by providing a slide gate valve having a slide gate housing with a bottom aperture, a heat-resistant closure plate, a slide plate and a movable aperture-closing slide.

A slide gate valve according to the invention makes it possible to replace the used slide plates in a simple manner, i.e., without disassembling the housing and without removing the assembly from the operating position, and, if necessary, also to replace the entire frame, without having to disassemble the slide valve housing. It is merely necessary to displace the slide carrying the frame until the openings or side apertures in the housing bottom are uncovered, and through which the frame may be removed from the housing and reinserted following the replacement of the damaged parts.

Further embodiments and advantages will become apparent from the following description of the preferred embodiment.

DETAILED DESCRIPTION OF THE PREFERRED EMBODIMENT

Figure 1:
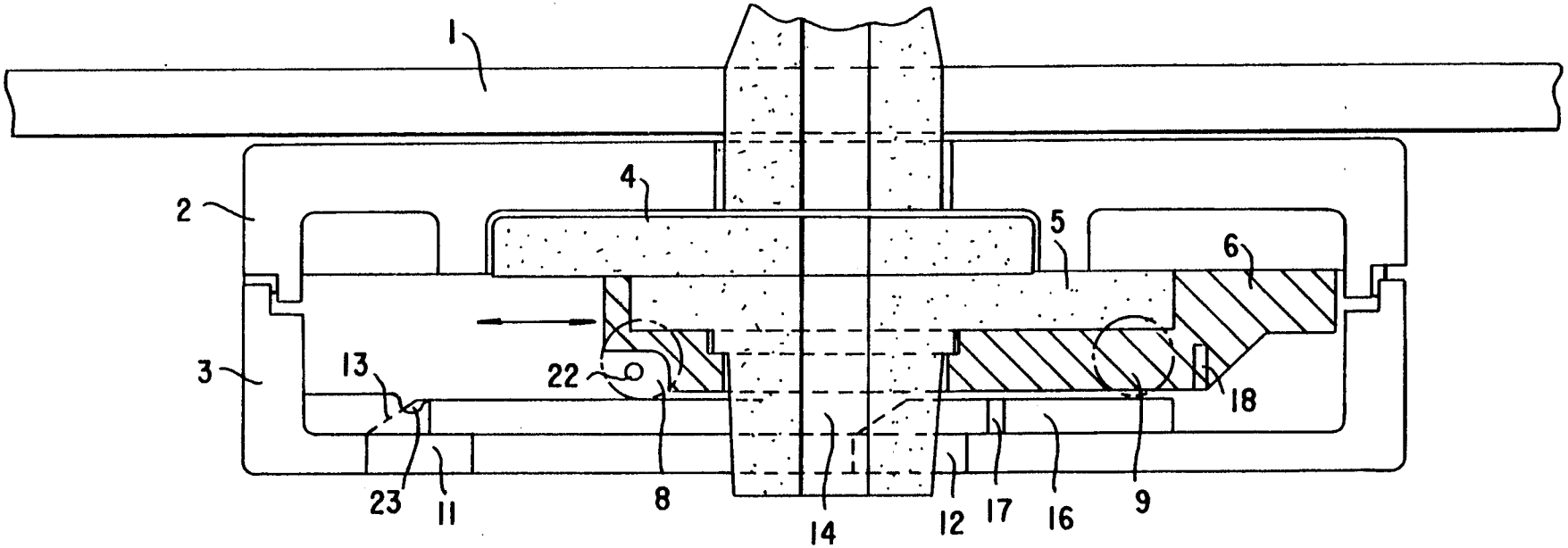
FIG. 1 shows a schematic view in section through a slide gate valve according to the invention in the open position.
Figure 2:
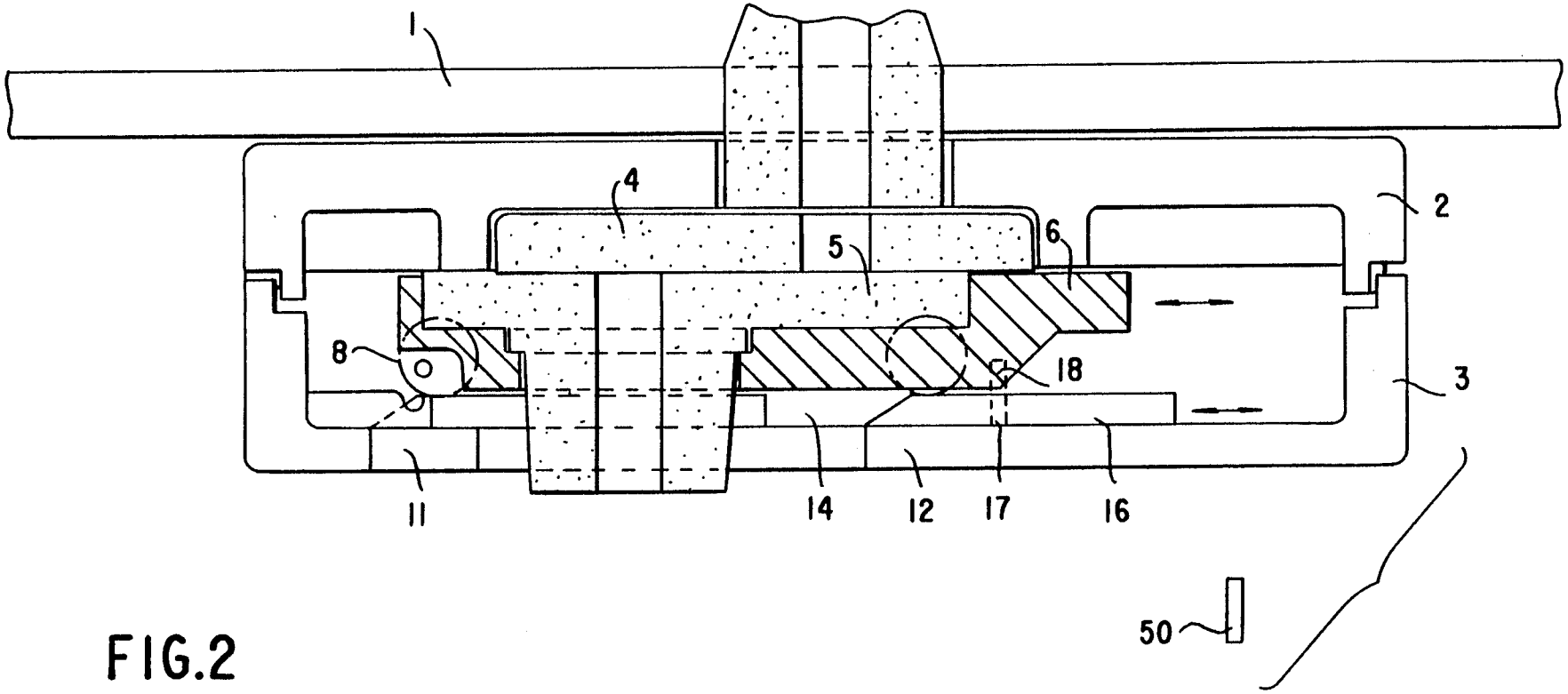
FIG. 2 shows the slide gate valve of FIG. 1 in the closed position.

FIGS. 1-4 show a slide gate valve according to the invention including a slide gate housing having a cover part 2 and a bottom part 3. The slide gate housing may be fastened to vessel 1. A closure plate 4, preferably made of ceramic material, is held stationary in the portion of cover part 2 which is fastened to the bottom part 1 of the vessel. A frame 6 is disposed in bottom part 3 and may be connected to a drive unit (not shown) for example, a pneumatic or hydraulic cylinder. Preferably, frame 6 carries a slide plate 5.

According to the invention, the frame or holder 6 is preferably equipped with two sets of rollers 8, 9. Housing bottom 3 includes a plurality of openings or side apertures 11, 12 which are spaced apart to correspond to the axial spacing of the roller sets 8, 9 so both roller sets 8, 9, may simultaneously pass through side apertures 11, 12. Frame 6 is supported by rollers 8, 9 and moves along slide 16. Slide 16 is provided with corresponding openings or open portions 13, 14 for opening or closing the passage openings or side aperture 11, 12 of the housing when displaced. According to an advantageous feature, the frame 6 and slide 16 may be provided with bores 17, 18 alignable in a plane (see FIG. 2) for the insertion of a connecting bolt or pin 50, although any other suitable mechanism, for example, a driver pin, a mechanical or magnetic clutch or the like, may also be used to produce a temporary fixed connection between frame 6 and slide 16.

Finally, in the embodiment shown in the drawings, each of rollers 8 (left side of the drawings) are preferably equipped with a lateral connecting bolt 22, and in the area of the openings or side apertures 11 a bolt-receiving receptacle 23 is provided on either side of the housing for bolts 22. Openings or open portions 13, 14 located in the slide 16 are preferably sloping ramps.

The slide gate valve according to the invention operates as follows:

FIG. 1 shows the slide gate in its open position, in which slide 16 closes openings or side apertures 11, 12 and the frame is positioned so closure plate 4 and slide plate 5 permit the flow of the melt from vessel 1. In this position, frame 6 may be freely displaced between its terminal positions to provide either an open or closed passage for the melt. Frame 6 moves on the rollers 8, 9 which are guided on slide 16 without risking deviation from the sealing plane. The slide is positively guided and requires no further safety measures.

To carry out repairs on the slide gate valve, for example, to replace slide plate 5, frame 6 is moved by the hydraulic drive to a left hand position, corresponding to the closing of the passage bore (See FIG. 2) and subsequently fixedly attached to the slide 16 by the insertion of a connecting bolt 50, into the bores 17, 18 of the frame 6 and the slide 16, respectively, which are aligned with each other in this position. Moving frame 6 into its right hand terminal position corresponding to FIG. 1, the slide 16 may also be moved to its right hand terminal position, thereby uncovering the openings or side apertures 11, 12. Following the release of the connecting bolt, it is now again possible to move the frame 6 independently of the slide 16. By moving frame 6 to its left hand terminal position, the frame may be taken from the housing, as the openings 11, 12 are open. The frame may be replaced or reinserted into the housing after the replacement of slide plate 5. The insertion of the frame and the closing of housing bottom is carried out in the inverse order.

Figure 3:
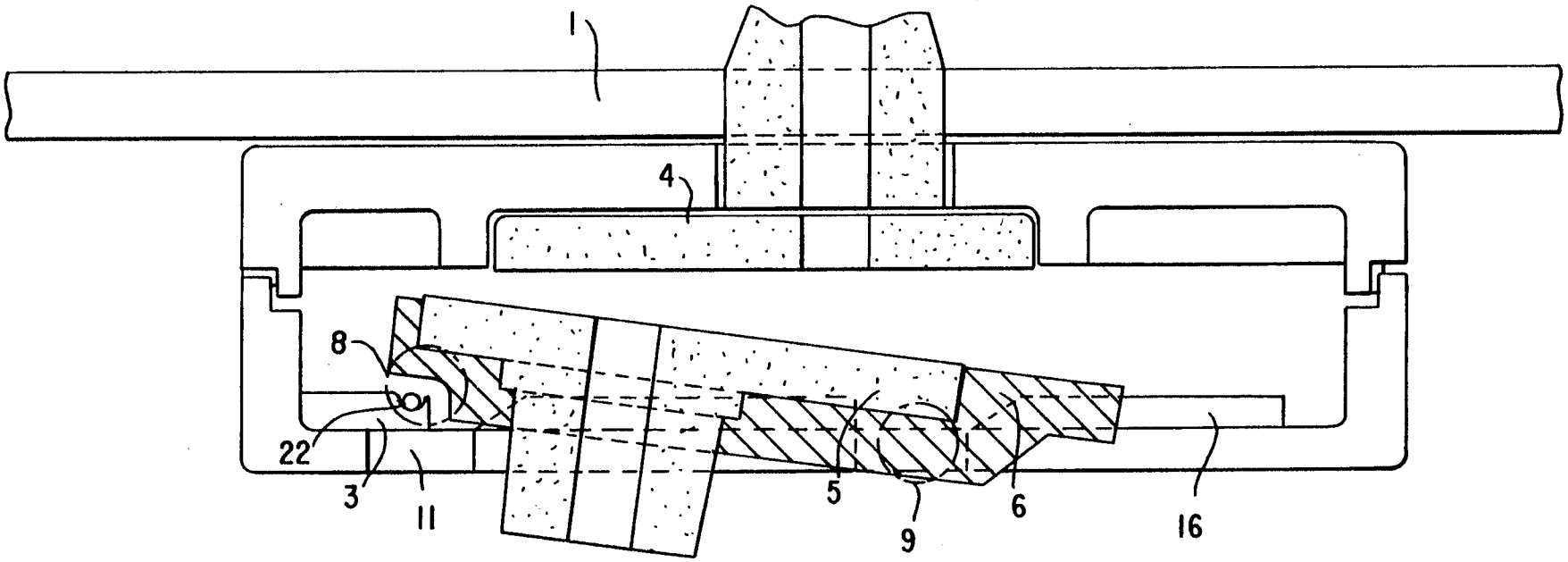
FIG. 3 shows the slide gate valve with the frame pivoted out one-half of the possible distance.
Figure 4:
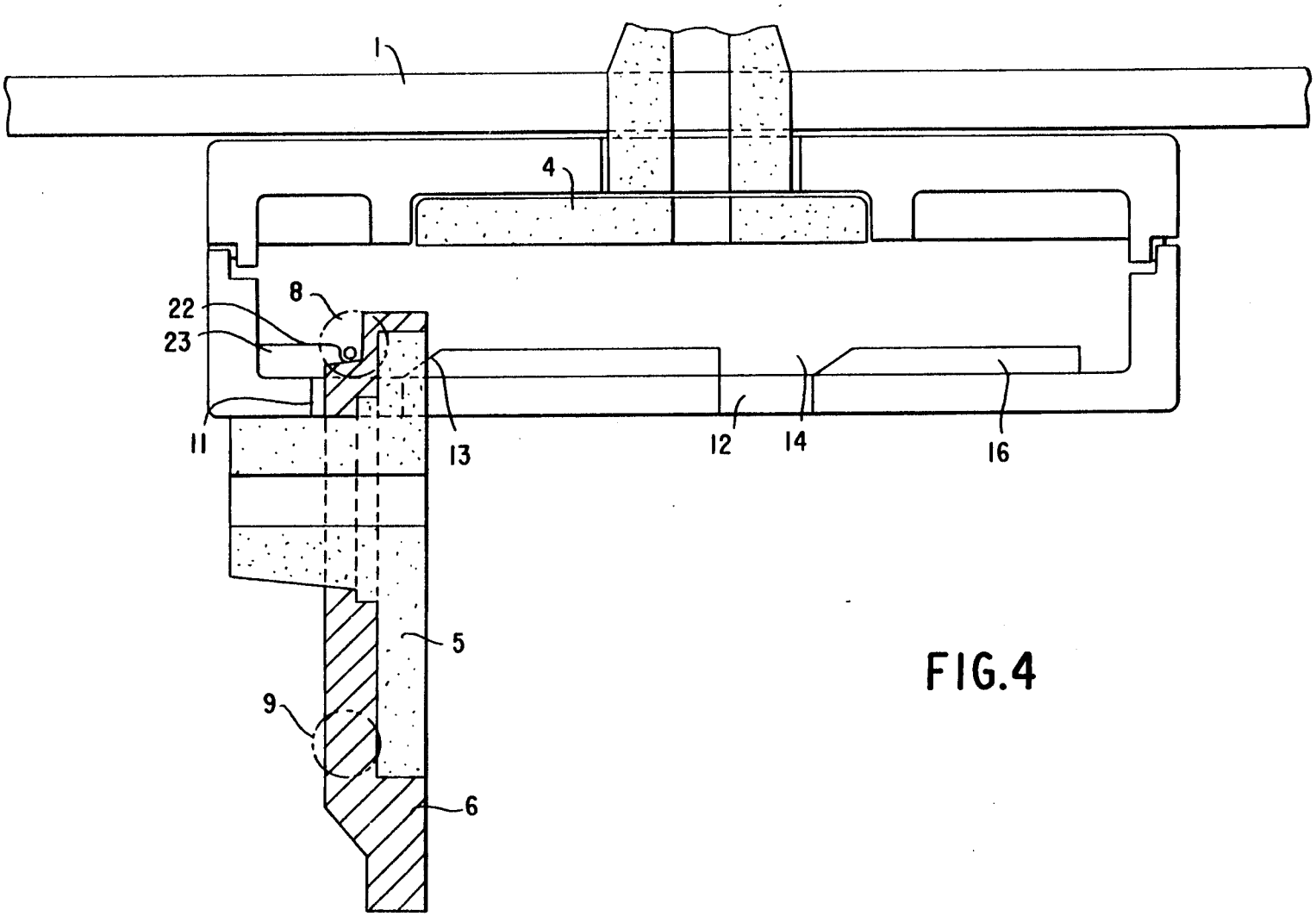
FIG. 4 shows the slide gate valve in its position prior to the removal of the slide.

In the embodiment shown in the drawings, the unintentional disengagement of the frame from the housing is prevented by plug-in bolts 22 in the rollers 8 in cooperation with a corresponding bolt-receiving receptacle 23. The removal of the frame is effected in a controlled manner initially on the side of the roller or wheel set 9, while the distal end of the frame is held by bolts 22 in the receptacle on its left side as shown in FIG. 3. After attaining the position shown in FIG. 4, the frame may be removed altogether from the housing by removing the bolts 22 or lifting the assembly out of the bolt-receiving receptacle 23. Following replacement of the slide plate 5, the frame may be returned into its position in the reverse sequence.

The illustrated embodiments are shown by way of example. The spirit and scope of the invention is not to be restricted by the preferred embodiment.

I claim:

1. A slide gate valve comprising:

a slide gate housing having a bottom aperture;

a heat-resistant closure plate located on said slide gate housing;

a movable frame having at least one set of rollers;

a slide plate contacting said closure plate and located on said movable frame; and a movable aperture-closing slide located along the bottom of said slide gate housing;

wherein said bottom aperture and said movable frame are relatively sized so said movable frame may be released through said bottom aperture.

2. A slide gate valve according to claim 1, further comprising:

detachable connecting element associated with said frame and said aperture-closing slide.

3. A slide gate valve according to claim 1, wherein:

said bottom aperture further exhibits a plurality of sets of spaced-apart side apertures, and said movable frame further comprises at least a second set of rollers axially spaced from said first set of rollers, the axial spacing of said sets of spaced-apart side apertures corresponding to the axial spacing of said sets of rollers.

4. A slide gate valve according to claim 2, wherein said connecting element comprises:

a first bore located in said frame;

a second bore located in said aperture-closing slide, wherein said first and second bores are aligned when said aperture-closing slide and said frame are in a first position.

5. A slide gate valve according to claim 1, further comprising:

a connecting bolt connected to each roller of one set of rollers and laterally spanning a corresponding side aperture.

6. A slide gate valve according to claim 5, further comprising:

a bolt-receiving receptacle associated with each of said bolts and located within said slide gate housing.

7. A slide gate valve according to claim 6, wherein said connecting bolts are releasable connecting bolts.

8. A slide gate valve according to claim 5, wherein said connecting bolts are releasable connecting bolts.

9. A slide gate valve according to claim 1, wherein said aperture-closing slide includes sloping ramps.

10. A slide gate valve according to claim 1, wherein said aperture-closing slide includes a frame-guiding slide.

11. A slide gate valve comprising:

a slide gate housing having a bottom aperture;

a movable slide plate assembly exhibiting at least a first set of rollers located within said slide gate housing; and an aperture-closing slide located along the bottom of said slide gate housing, wherein said aperture-closing slide is displaceable between a first position partially blocking passage of a portion of said movable slide plate assembly through recesses in said bottom aperture and a second position permitting passage of a portion of said movable slide plate assembly through said recesses.

12. A slide gate valve according to claim 11, further comprising:

detachable connecting element associated with said frame and said aperture-closing slide.

13. A slide gate valve according to claim 11, wherein:

said bottom aperture further exhibits a plurality of sets of spaced-apart recesses, and said movable slide plate assembly further comprises a second set of rollers, wherein the axial spacing of said spaced-apart recesses corresponds to the axial spacing between said first and second sets of rollers.

14. A slide gate valve according to claim 12, wherein said connecting element comprises:

a first bore located in said frame;

a second bore located in said aperture-closing slide, wherein said first and second bores are aligned when said aperture-closing slide and said frame are in a first position.

15. A slide gate valve according to claim 11, further comprising:

a connecting bolt connected to each roller of said first set of rollers and laterally spanning a corresponding recess.

16. A slide gate valve according to claim 15, further comprising:

a bolt-receiving receptacle associated with each of said bolts and located within said slide gate housing.

17. A slide gate valve according to claim 16, wherein said connecting bolts are releasable connecting bolts.

18. A slide gate valve according to claim 15, wherein said connecting bolts are releasable connecting bolts.

19. A slide gate valve according to claim 11, wherein said aperture-closing slide includes sloping ramps.

20. A slide gate valve according to claim 11, wherein said aperture-closing slide includes a frame-guiding slide.

* * * * *